US010243281B2

(12) United States Patent
Ruggiero

(10) Patent No.: US 10,243,281 B2
(45) Date of Patent: Mar. 26, 2019

(54) ELECTRICAL CONNECTORS

(71) Applicant: Hubbell Incorporated, Shelton, CT (US)

(72) Inventor: Glen Harrison Ruggiero, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/486,653

(22) Filed: Apr. 13, 2017

(65) Prior Publication Data

US 2017/0302009 A1 Oct. 19, 2017

Related U.S. Application Data

(60) Provisional application No. 62/324,479, filed on Apr. 19, 2016, provisional application No. 62/347,943, filed on Jun. 9, 2016.

(51) Int. Cl.
*H01R 4/34* (2006.01)
*H01R 13/52* (2006.01)

(52) U.S. Cl.
CPC ..... *H01R 4/34* (2013.01); *H01R 13/5205* (2013.01)

(58) Field of Classification Search
CPC .... H01R 4/34; H01R 13/748; H01R 13/5202; H01R 13/5205
USPC ..... 439/805, 78, 559, 564, 573, 939
See application file for complete search history.

(56) References Cited

U.S. PATENT DOCUMENTS 2,441,457 A * 5/1948 Treanor ..... H01B 17/308 174/152 R
2,516,916 A * 8/1950 Richards ..... H01L 31/00 136/256
2,806,999 A * 9/1957 Pichitino ..... H01R 4/30 174/153 R
3,850,501 A * 11/1974 Butterfield ..... H01B 17/58 439/196
3,992,075 A * 11/1976 Cannarsa ..... H01R 11/289 439/755
4,231,631 A * 11/1980 Guerinault ..... H01M 2/24 439/559
4,241,152 A * 12/1980 Klink ..... H01M 2/06 429/181
4,362,351 A * 12/1982 Wible ..... H01R 4/302 439/738
4,537,460 A * 8/1985 McCaig ..... H01R 11/26 439/769
4,614,397 A * 9/1986 Flanigan ..... H01B 17/308 439/277
5,248,265 A * 9/1993 Goto ..... H01R 13/5213 439/559
5,580,277 A * 12/1996 Emery ..... H01Q 1/1207 343/888
6,553,728 B1 * 4/2003 Zurn ..... E06B 3/677 251/215
7,038,339 B2 * 5/2006 Gandrud ..... H02K 5/225 310/71

(Continued)

*Primary Examiner* — Tulsidas C Patel
*Assistant Examiner* — Travis Chambers
(74) *Attorney, Agent, or Firm* — Wissing Miller LLP

(57) ABSTRACT

Electrical connectors used to ground and/or electrically bond objects such as panels having metal outer and inner walls. The electrical connectors use male and female posts having associated washers that facilitate the flow of electric current between the outer and inner walls while providing a water-tight seal.

20 Claims, 18 Drawing Sheets

(56) References Cited

U.S. PATENT DOCUMENTS

| | | | | |
|---|---|---|---|---|
| 7,967,972 | B2 * | 6/2011 | Glass | C23F 13/20<br>204/196.2 |
| 9,252,549 | B2 * | 2/2016 | Garriga | H01R 4/34 |
| 9,397,430 | B2 * | 7/2016 | Eliassen | H01R 13/5219 |

* cited by examiner

Fig. 1
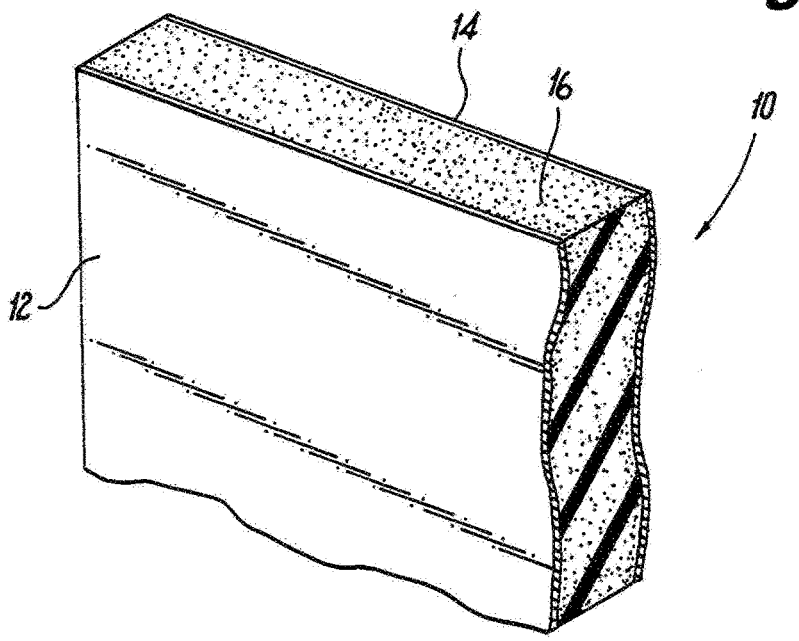
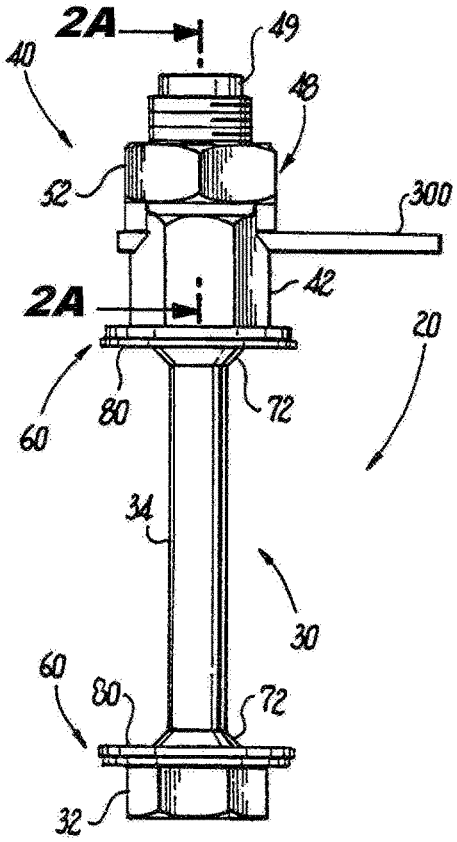
Fig. 2
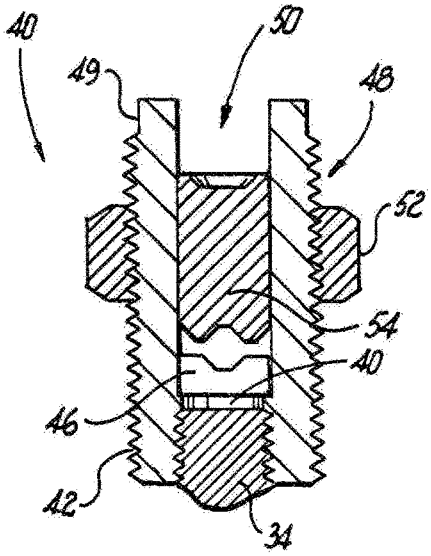
Fig. 2A

Fig. 3
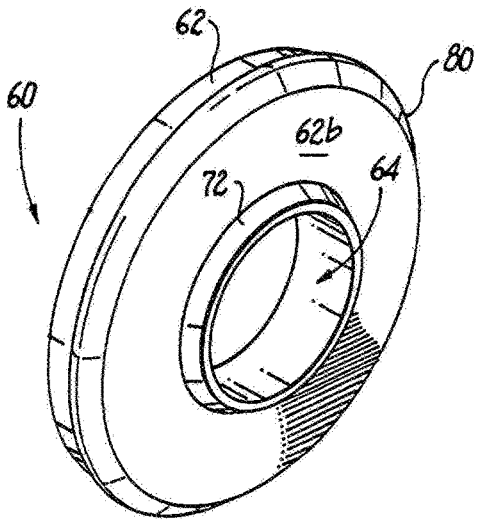
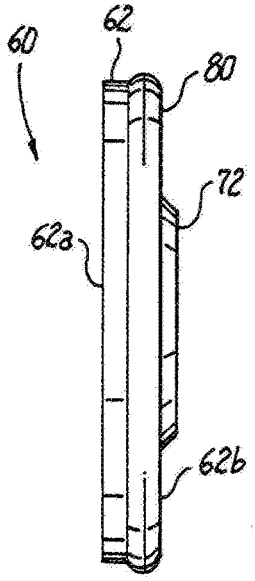
Fig. 4
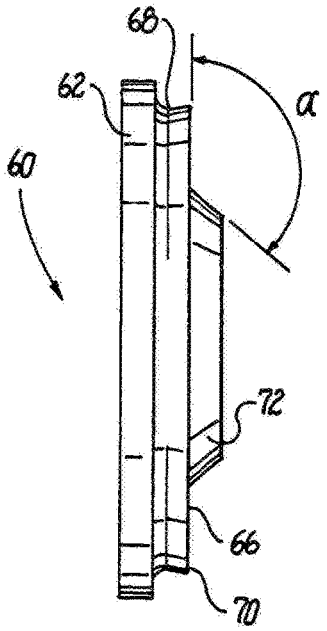
Fig. 5
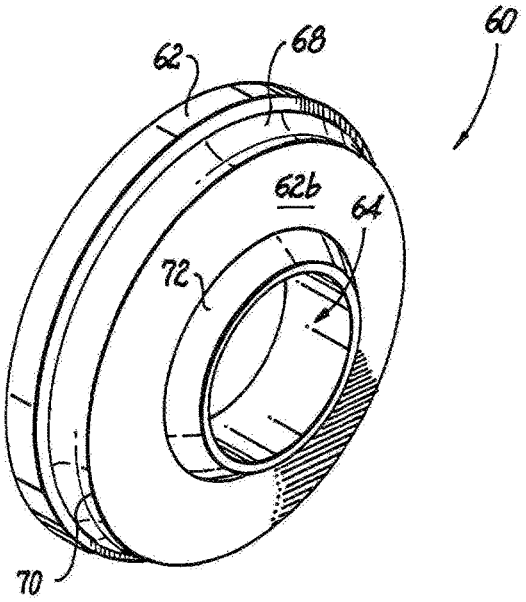
Fig. 6

Fig. 25
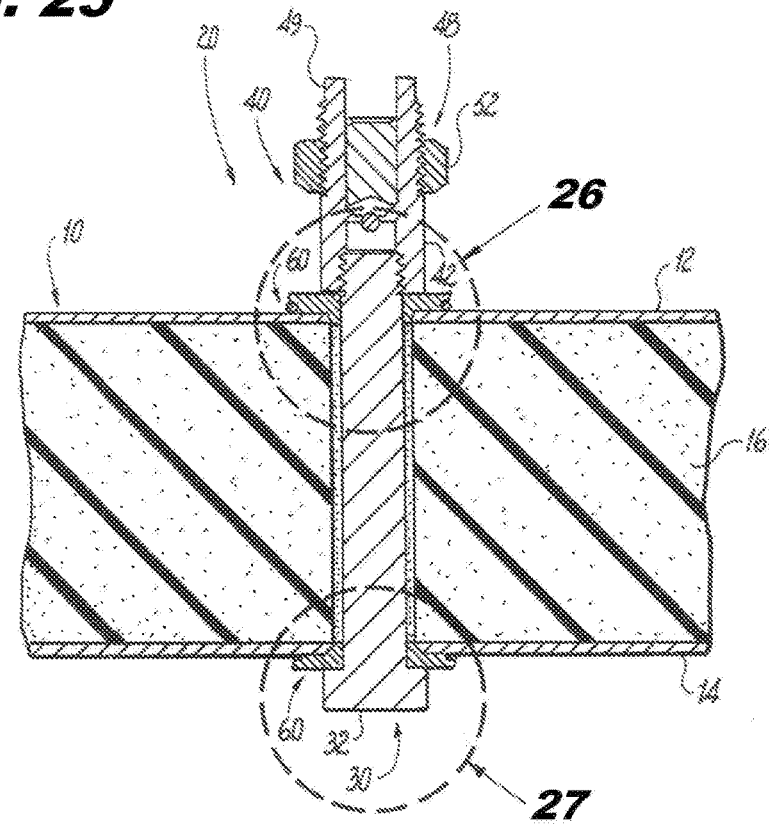
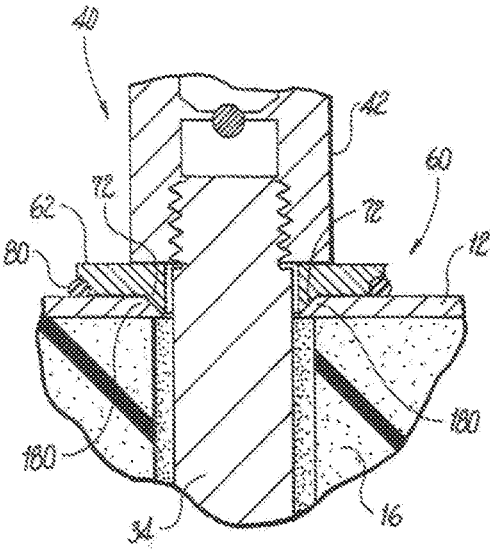
Fig. 26
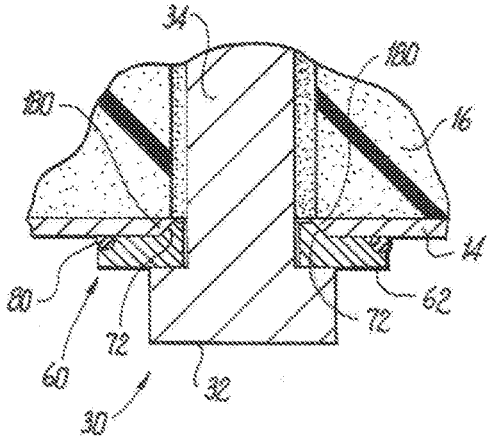
Fig. 27

Fig. 28
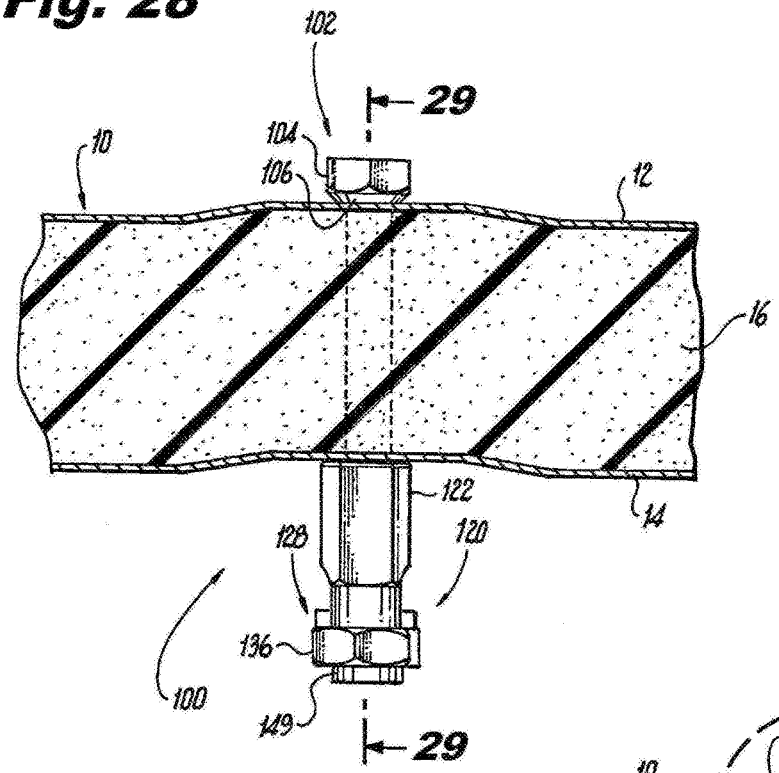
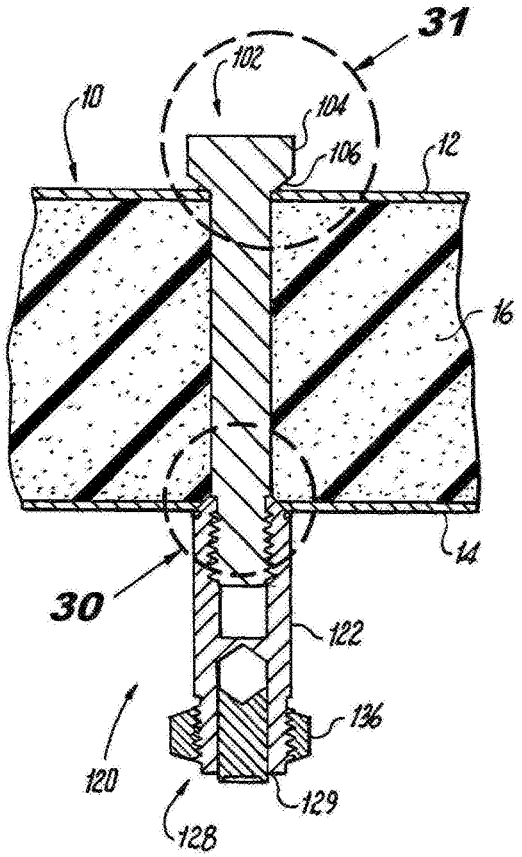
Fig. 29

ELECTRICAL CONNECTORS

CROSS REFERENCE TO RELATED APPLICATIONS

The present application is based on and claims benefit from co-pending U.S. Provisional Application Ser. No. 62/324,479 filed Apr. 19, 2016 entitled "Electrical Connectors" and from co-pending U.S. Provisional Application Ser. No. 62/347,943 filed Jun. 9, 2016 entitled "Electrical Connectors" the entire contents both are incorporated herein in their entirety by reference.

BACKGROUND

Field

The present disclosure relates generally to electrical connectors, and more particularly to electrical connectors used to establish electrical connections between conductors and metal objects.

Description of the Related Art

Panels made of inner and outer metal walls separated by a filler or insulating material are used for numerous applications. The panels can be used to construct exterior walls, roofs, facades, soffits, interior walls, ceilings, cold storage enclosures as well as other enclosures, and trailers. The panels can have architectural wall applications where an outer surfaces of the metal walls can have an architectural profile instead of a flat profile. The outer surface of the metal walls may be coated with a non-conductive coating to protect the metal walls from environmental conditions. In certain applications, the metal walls of such panels may need to be grounded and/or electrically bonded in order to meet national or local electrical codes.

SUMMARY

The present disclosure provides descriptions of embodiments for electrical connectors used to establish electrical connections between conductors and metal objects. As an example, the electrical connectors can be used to ground and/or electrically bond metal surfaces of panels. In one exemplary embodiment, the electrical connector comprises a first post having a first washer and a second post that can be attached to the first post and having a second washer. The first washer has a first base, a first seal member positioned in a seal member retainer, and a first press fit anchor member. The second washer has a second base, a second seal member positioned in a seal member retainer, and a second press fit anchor member. In another exemplary embodiment, the first washer has a first base, a first seal member positioned in a seal member retainer, and a first wedge fit anchor member, and the second washer has a second base, a second seal member positioned in a seal member retainer, and a second wedge fit anchor member.

In another exemplary embodiment, the electrical connector comprises a first post having an associated washer, and a second post having an associated washer. The washers comprise a base, a seal member positioned in a seal member retainer, and a countersink profile used to establish electrical connections between conductors and metal objects. The first post may be a male post and the second post may be a female post. Male posts include a head and a stem extending from the head and having a free end. Female posts include a base having a mounting aperture at one end and a conductor attaching assembly coupled to the base and used to clamp a conductor to the female post. In an exemplary embodiment, the conductor attaching assembly includes a split bolt, a clamping member and a clamping member adjuster. The split bolt extends from the base and has a channel configured to receive the conductor. The clamping member is positioned within the channel and is coupled to the clamping member adjuster which is movably coupled to the split bolt. When the clamping member adjuster is moved along the split bolt to an open position the clamping member moves to the open position. When the clamping member adjuster is moved along the split bolt to a clamping position, the clamping member moves to the clamping position where a conductor being supported by a conductor rest is clamped to the female post.

In another exemplary embodiment, the electrical connector includes a post having head and a free end, a pair of washers, and a conductor clamping member. Each washer includes a base, a seal member positioned in a seal member retainer, and a countersink profile. The conductor clamping member can be attached to the free end of the post.

In another exemplary embodiment, the electrical connector comprises a first post having a countersink profile and a seal member positioned adjacent the countersink profile, and a second post that can be attached to the first post. The second post has one end with a seal member positioned in a seal member retainer, and a countersink profile. The countersink profiles facilitate grounding and/or electrical bonding.

BRIEF DESCRIPTION OF THE DRAWINGS

The figures depict configurations for purposes of illustration only. One skilled in the art will readily recognize from the following description that alternative configurations of the structures illustrated herein may be employed without departing from the principles described herein, wherein:

FIG. 1 is a front perspective view of a double side metal panel;

FIG. 2 is a side elevation view of an exemplary embodiment of an electrical connector according to the present disclosure, illustrating a male post coupled to a female post with washers used to establish electrical connections between conductors and metal objects and for facilitating a watertight seal;

FIG. 2A is a cross-sectional view of the female post of FIG. 2 taken along line 2A-2A;

FIG. 3 is a bottom perspective view of a washer used with the electrical connector of FIG. 2;

FIG. 4 is a side elevation view of the washer of FIG. 3, illustrating a seal member attached to the washer;

FIG. 5 is a side elevation view of the washer of FIG. 3 without the seal member;

FIG. 6 is bottom plan view of the washer of FIG. 5;

FIG. 25 is a cross-sectional view of the electrical connector and panel of FIG. 24 taken along line 25-25;

FIG. 26 is an enlarged cross-sectional view of the interconnection between the female post of the electrical connector of FIG. 2 and the panel of FIG. 1;

FIG. 27 is an enlarged cross-sectional view of the interconnection between the male post of the electrical connector of FIG. 2 and the panel of FIG. 1;

FIG. 28 is a side elevation view of the electrical connector of FIG. 8 secured to panel of FIG. 1;

FIG. 29 is cross-sectional view of the electrical connector and panel of FIG. 28 taken along line 29-29;

DETAILED DESCRIPTION

Figure 7:
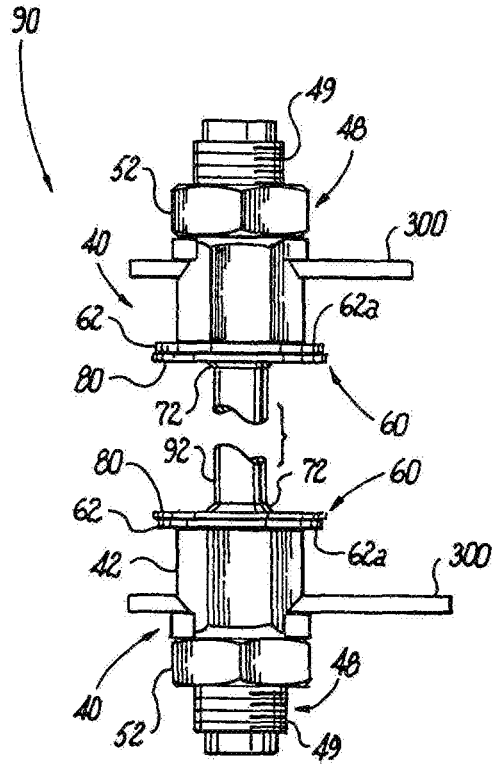
FIG. 7 is a side elevation view of another exemplary embodiment of an electrical connector according to the present disclosure, illustrating a first female post coupled to a second female post.
Figure 8:
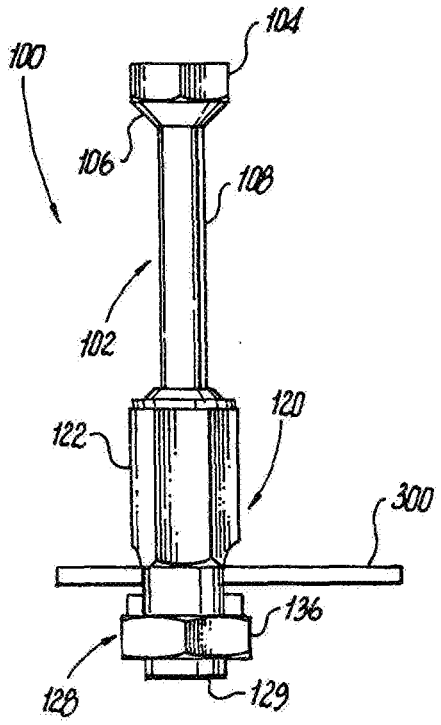
FIG. 8 is a side elevation view of another exemplary embodiment of an electrical connector according to the present disclosure, illustrating a male post coupled to a female post.

The present disclosure provides descriptions of embodiments for electrical connectors used to establish electrical connections between conductors and metal objects. As an example, the electrical connectors according to the present disclosure can be used for grounding and/or electrically bond panels having metal outer and inner walls. FIG. 1 is an exemplary embodiment of a panel 10 contemplated by the present disclosure. The panel 10 has a metal outer wall 12, a metal inner wall 14, and a filler material 16, such as foam insulation, between the outer and inner walls. In certain applications, the outer and/or inner metal walls of the panel include a non-conductive coating, e.g., oxide, paint and/or anodization, to protect the panel from the environment. To establish electrical connections between conductors and panels with outer and inner walls that have non-conductive outer coatings, the non-conductive coating would have to be pierced. The electrical connector according to the present disclosure is capable of establishing electrical connections between conductors and such panels. This specification and the accompanying drawings are to be regarded in an illustrative sense rather than a restrictive sense. Various modifications may be made thereto without departing from the spirit and scope of the present disclosure.

Referring to FIGS. 2 and 2A, an exemplary embodiment of an electrical connector according to the present disclosure is shown. In this exemplary embodiment, the electrical connector 20 includes a male post 30, a female post 40, and a pair of washers 60. The male post 30 has a head 32, such as a hex head, and a stem 34 extending from the head 32 to a free end. The size, shape and configuration of the stem may vary depending upon the particular panel or other object to which the electrical connector 20 is to be secured. For example, the stem may be a short stem or an elongated stem. The stem 34 may be a fully threaded stem, or the stem may have a smooth portion followed by a threaded portion at the free end so that the male post 30 can be releasably secured to the female post 40.

The female post 40 includes a base 42 having a mounting aperture 44, seen in FIG. 2A, for receiving a portion of the stem 34 of the male post 30. The mounting aperture 44 may be a threaded aperture to receive the threaded portion of the stem 34. The base 42 also includes a conductor rest 46 configured to support an electrical conductor 300 (also referred to herein as a "conductor"). Extending from, coupled to or integrally formed into the base 42 is a conductor attaching assembly 48 used to clamp a conductor being supported by the conductor rest 46 to the base 42 of the female post 40. In the embodiment shown, the conductor attaching assembly 48 includes a split bolt 49 having a channel 50, a clamping member 54 positioned within the channel 50, and a clamping member adjuster 52 coupled to the clamping member 54. The clamping member adjuster 52 is also coupled to the split bolt 49 such that movement of the clamping member adjuster 52 along the split bolt is translated to corresponding movement of the clamping member 54. The clamping member adjuster 52 is movable between an open position where a conductor can be inserted into the channel 50 and a clamping position where the clamping member 54 engages a conductor 300 within the channel and presses the conductor against the conductor rest 46 so as to clamp the conductor to the base 42. In an exemplary embodiment, the clamping member adjuster 52 is a nut that can be threaded along the split bolt between the open and clamping positions, and the clamping member is a rigid plate or rod.

Referring to FIGS. 3-6, the washers 60 include a base 62 having a circular shape with a substantially flat top surface 62*a* and a bottom surface 62*b* and an aperture 64 in a center portion of the base 62 for receiving the stem, e.g., stem 34, of the male post 30. Extending from the bottom surface 62*b* of the base 62 adjacent the periphery of the base is a seal member retainer 66, seen in FIG. 5, for releasable attaching a seal member 80, seen in FIG. 4, to the washer 60. The seal member retainer 66 is a circular member having a diameter that is preferably smaller than the diameter of the base 62. In the exemplary embodiment shown, the seal member 80 is an O-ring, and the seal member retainer 66 is a ring that includes an arcuate surface 68 having a lip 70 to releasable attach the seal member 80 to the washer 60. The seal member 80 provides a watertight seal between the washer 60 and a metal wall of a panel, e.g., panel 10, or other object. Extending from the bottom surface 62*b* of the base 62 is a countersink profile 72 surrounding the aperture 64, as shown in FIGS. 3 and 6. The countersink profile 72 has a taper angle "α" that can be any size sufficient to provide a surface area of metal that is capable of contacting an opposing metal surface in a countersink cut into a metal panel wall or other object. For example, the taper angle "α" may be in the range from about 105 degrees to about 165 degrees. Preferably, the angle "α" is 135 degrees so that the countersink profile 72 can mate with an approximate 90 degree countersink (or 45 degree chamfer) in the metal wall or other object. The countersink profile 72 of the base 62 is used to establish electrical connections between conductors and a panel, e.g., panel 10, or other object. For example, the countersink profile 72 of the base 62 can be used to facilitate grounding and/or electrically bonding the electrical connector 20 to panel 10.

Referring to FIG. 7, another exemplary embodiment of an electrical connector according to the present disclosure is shown. In this exemplary embodiment, the electrical connector 90 includes a first female post 40, a second female post 40, a stem 92 that can be coupled to the first and second female posts 40, and a pair of washers 60. The first and second female posts 40 are the same as female post described above, and the washers 60 is the same as the washer described above. As such, a description of the female posts and washer will not be repeated. For example, the size of the stem 92 may vary depending upon the particular panel to which the electrical connector 90 is to be secured. The stem 92 may be a short stem or an elongated stem. The stem 92 may be a threaded rod that can be threaded into the mounting aperture 44 of the female posts, or the stem 92 may have a smooth portion with threaded ends that can be threaded into the mounting aperture 44 of the female posts 40, seen in FIG. 2A.

Figure 9:
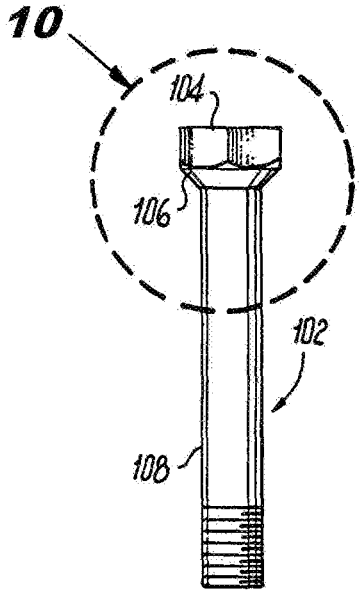
FIG. 9 is a side elevation view of the male post of the electrical connector of FIG. 8.
Figure 10:
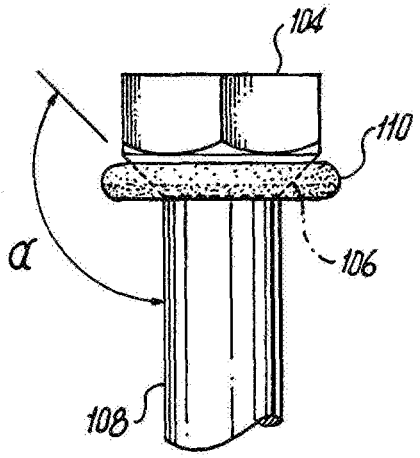
FIG. 10 is an enlarged side elevation view of a head of the male post of FIG. 9 having a seal member around a countersink profile of the head.

Referring to FIGS. 8-13, another exemplary embodiment of an electrical connector according to the present disclosure is shown. In this exemplary embodiment, the electrical connector 100 includes a male post 102 and a female post 120. The male post 102 has a head 104, such as a hex head, as seen in FIG. 9. The head 104 has a countersink profile 106 and a stem 108 extending from the countersink profile 106 to a free end. A seen in FIG. 10, the countersink profile 106 of the head 104 has a taper angle "α" that can be any size sufficient to provide a surface area of metal that is capable of contacting an opposing metal surface in a countersink cut into a metal panel wall or other object. For example, the taper angle "α" may be in the range from about 105 degrees to about 165 degrees. Preferably, the angle "α" is 135 degrees so that the countersink profile 106 can mate with an approximate 90 degree countersink (or 45 degree chamfer) in the metal panel wall or other object. The countersink profile 106 of the male post 102 is used to establish electrical connections between conductors and a panel, e.g., panel 10, or other object. For example, the countersink profile 106 of the male post 102 can be used for grounding and/or electrically bonding the electrical connector 100 to panel 10. The size, shape and configuration of the stem 108 may vary depending upon the particular panel to which the electrical connector 100 is to be secured. For example, the stem 108 may be a short stem or an elongated stem. The stem 108 may be a fully threaded stem, or the stem may have a smooth portion followed by a threaded portion at the free end so that the male post 102 can be releasably secured to the female post 120. As seen in FIG. 10, the male post 102 also include a seal member 110, which may be for example an O-ring, positioned around the countersink profile 106. The seal member 110 provides a watertight seal between the male post 102 and a metal wall of a panel, e.g., panel 10 or other object.

Figure 11:
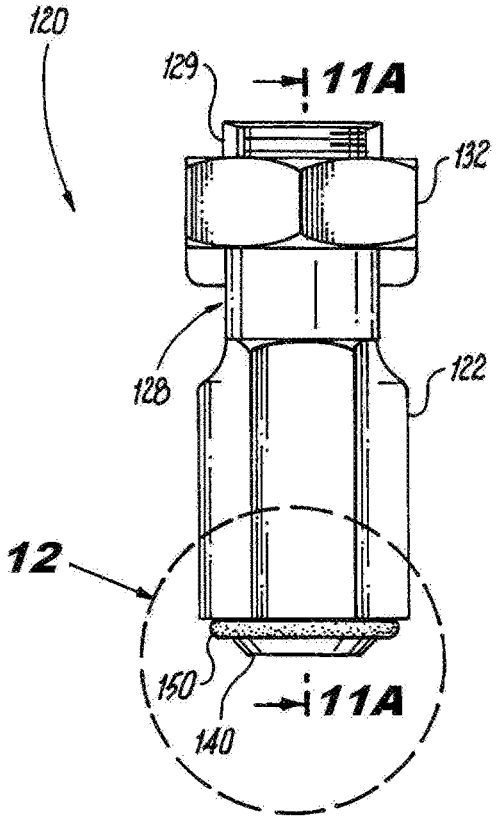
FIG. 11 is a side elevation view of the female post of the electrical connector of FIG. 8.
Figure 11A:
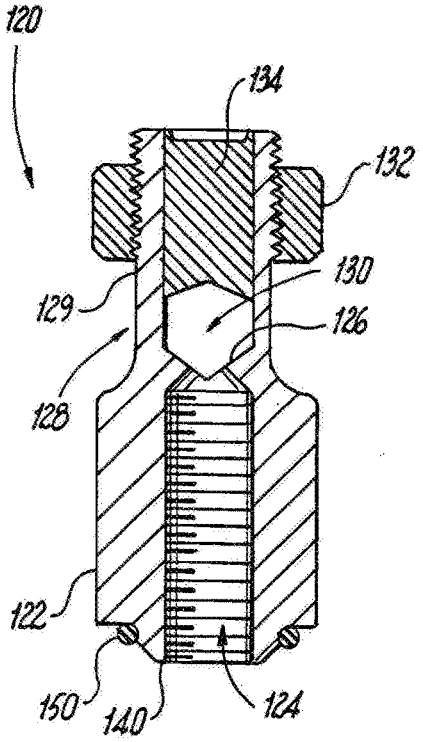
FIG. 11A is a cross-sectional view of the female post of FIG. 11 taken along line 11A-11A.
Figure 12:
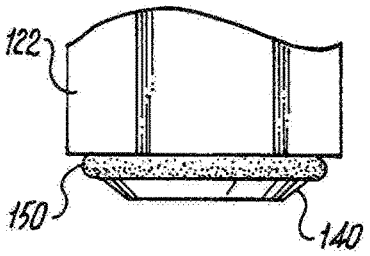
FIG. 12 is an enlarged view of an end of the female post of FIG. 11, illustrating a countersink profile and a seal member.
Figure 13:
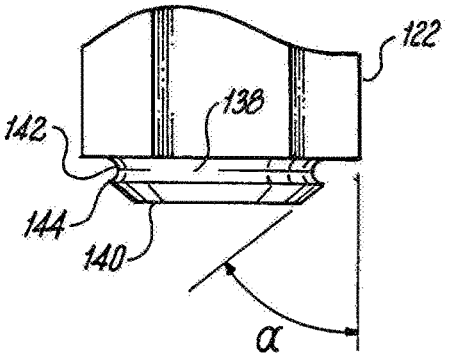
FIG. 13 is an enlarged view of the end of the female post of FIG. 12 without the seal member, illustrating a seal member retainer and a countersink profile.

Referring to FIGS. 11 and 11A, the female post 120 may include a base 122 having a mounting aperture 124 for receiving a portion of the stem 108 of the male post 102. The mounting aperture 124 may be a threaded aperture to receive the threaded portion of the stem 108. Extending from, coupled to or integrally formed into the base 122 is a conductor attaching assembly 128 used to clamp a conductor being supported by a conductor rest 126 to the base 122 of the female post 120. In the embodiment shown, the conductor attaching assembly 128 includes a split bolt 129 having a channel 130, a clamping member 134 positioned within the channel 130 and a clamping member adjuster 132 coupled to the clamping member 134. The clamping member adjuster 132 is also coupled to the split bolt 129 such that movement of the clamping member adjuster 132 along the split bolt is translated to corresponding movement of the clamping member 134. The clamping member adjuster 132 is movable between an open position where a conductor 300 can be inserted into the channel 130 and a clamping position where the clamping member 134 engages the conductor 300 within the channel and presses the conductor against the conductor rest 126 so as to clamp the conductor to the base 122. In an exemplary embodiment, the clamping member adjuster 132 is a nut that can be threaded along the split bolt between the open and clamping positions, and the clamping member is a rigid plate or rod. At the end of the base 122 with the mounting aperture 124 is a seal member retainer 138, seen in FIG. 13, for releasable attaching a seal member 150, seen in FIG. 12, to the female post 120. The seal member retainer 138 is a circular member having a diameter that is preferably smaller than the outer diameter of the base 122. In the exemplary embodiment shown in FIGS. 12 and 13, the seal member 150 is an O-ring, and the seal member retainer 138 is a ring that includes an arcuate surface 142 having a lip 144 to releasable attach the seal member 150 to the base 122. Extending from the seal member retainer 138 is a countersink profile 140. The countersink profile 140 has a taper angle "α" that can be any size sufficient to provide a surface area of metal that is capable of contacting an opposing metal surface in a countersink cut into a metal panel wall or other object. For example, the taper angle "α" may be in the range from about 105 degrees to about 165 degrees. Preferably, the angle "α" is 135 degrees so that the countersink profile 140 can mate with an approximate 90 degree countersink (or 45 degree chamfer) in a metal wall or other object. The countersink profile 140 is used to establish electrical connections between conductors and a panel, e.g., panel 10, or other object. For example, the countersink profile 140 of the female post 120 can be used to facilitate grounding and/or electrical bonding of the electrical connector 100 to panel 10.

Figure 14:
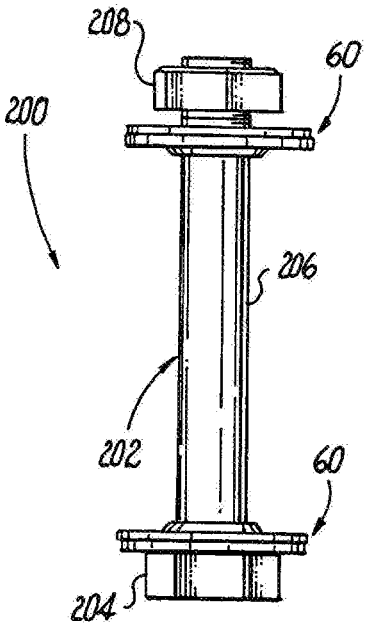
FIG. 14 is a side elevation view of another exemplary embodiment of an electrical connector according to the present disclosure, illustrating a male post coupled to a conductor clamping member with washers used to establish electrical connections between conductors and metal objects and for facilitating a watertight seal.
Figure 15:
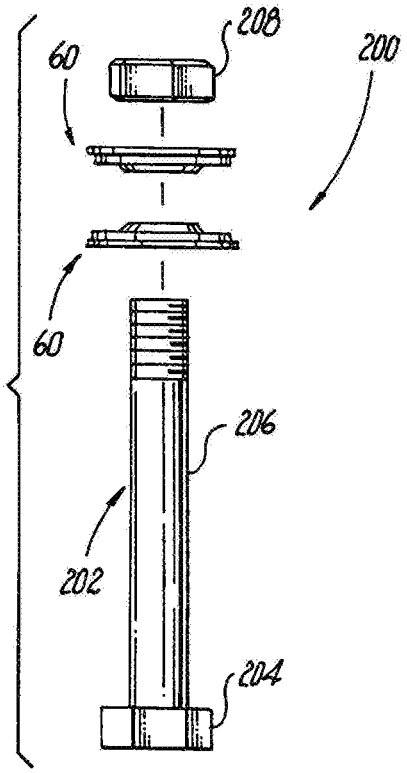
FIG. 15 is a side elevation view with parts separated of the electrical connector of FIG. 14.

Referring to FIGS. 14 and 15, another exemplary embodiment of an electrical connector according to the present disclosure is shown. In this exemplary embodiment, the electrical connector 200 includes a male post 202 having a head 204, such as a hex head, a stem 206 extending from the head 204 to a free end and a pair of washers 60. The washers 60 are described above and for ease of description are not reproduced. The size, shape and configuration of the stem 206 may vary depending upon the particular panel to which the electrical connector 200 is to be secured. For example, the stem 206 may be a short stem or an elongated stem. The stem 206 may be a fully threaded stem, or the stem may have a smooth portion followed by a threaded portion at the free end so that the male post 202 can be releasably secured to a conductor clamping member 208. The conductor clamping member 208 may be, for example, a nut that is threaded onto the threaded free end of the male post 206.

The male posts, female posts and the washers described herein are made of an electrically conductive material that establishes electrical connections between conductors and objects, such as panel 10. For example, male posts, female posts and the washers are made of an electrically conductive material that facilitates the grounding and/or electrical bonding function of the electrical connector 10. Examples of electrically conductive metals include cast copper alloy, copper, brass, steel, stainless steel, galvanized steel, silicone bronze, tin, aluminum, or aluminum alloy.

Figure 16:
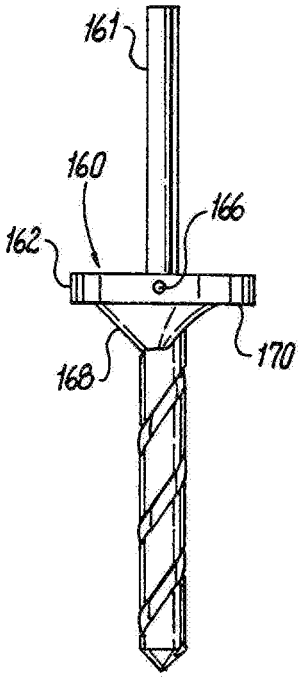
FIG. 16 is a side elevation view of a drill bit and an exemplary embodiment of a countersink adapter according to the present disclosure secured to the drill bit.
Figure 17:
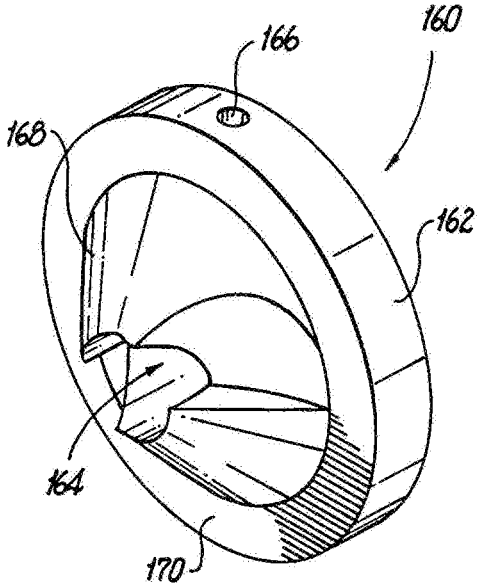
FIG. 17 is a bottom perspective view of the countersink adapter of FIG. 16.
Figure 18:
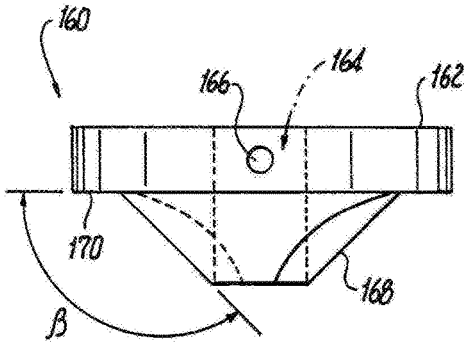
FIG. 18 is a side elevation view of the countersink adapter of FIG. 16.
Figure 19:
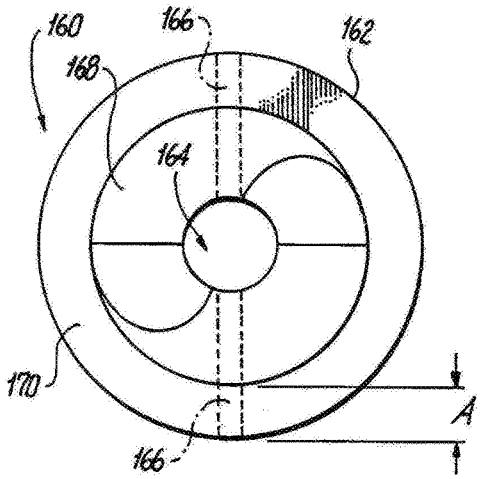
FIG. 19 is a bottom plan view of the countersink adapter of FIG. 16.
Figure 20:
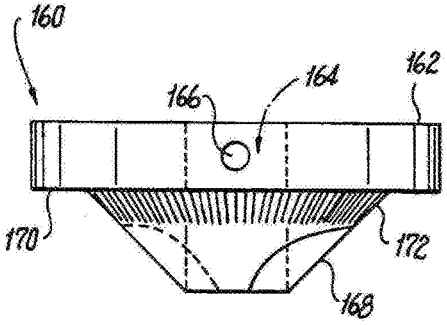
FIG. 20 is a side elevation view of another exemplary embodiment of the countersink adapter according to the present disclosure.
Figure 21:
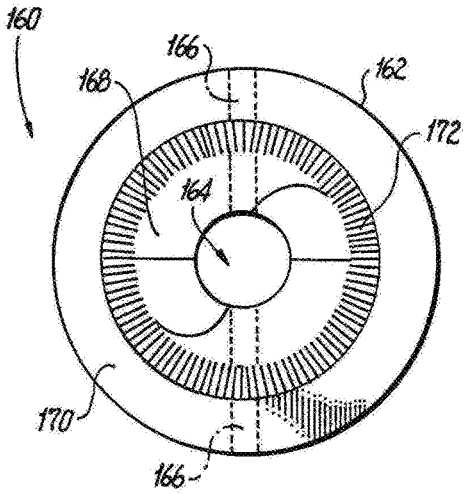
FIG. 21 is a bottom plan view of the countersink adapter of FIG. 20.

Turning to FIGS. 16-21, exemplary embodiments of a countersink adapter that can be used when installing the electrical connectors of the present disclosure is shown. In the exemplary embodiment of FIGS. 16-19, the countersink adapter 160 includes a base 162 that is a solid cylindrical body having a center mounting aperture 164 configured to permit a drill bit 161 to pass there through, as seen in FIG. 16. The diameter of the base 162 may vary depending upon the size of the countersink to be drilled into the panel wall or other object. The diameter of the mounting aperture 164 can be configured to fit any size drill bit 161, such as a ⅛ inch, ⅜ inch or a ½ inch diameter drill bit. The countersink adapter 160 can be releasably attached to the drill bit 161 using a set screw (not shown) through threaded set screw aperture 166, seen in FIG. 17, in the base 162. Extending from one surface of the base 162 and around the mounting aperture 164 is a countersink cutter 168, seen in FIGS. 17 and 19. The countersink cutter 168 may come in many shapes and sizes depending upon the dimensions of the countersink profile of the electrical connector. The countersink cutter 168 may be, for example, a zero fluted cutter or a fluted cutter. In the example shown, the countersink cutter 168 is a two fluted cutter. The taper angle "β" of the countersink cutter 168, seen in FIG. 18, may be, for example, in the range from about 105 degrees to about 165 degrees. Preferably, the angle "β" is the same as the taper angle "α" of the countersink profile of the electrical connector, which may be for example 135 degrees. Referring to FIG. 19, the diameter of the countersink cutter 168 is less than the diameter of the base 162, as shown. The portion of the base 162 between an outer edge of the base 162 and an outer edge of the countersink cutter 168 provides a stop 170. The distance "A" between the outer edge of the base 162 and the outer edge of the countersink cutter 168 defines the size of the stop 170. The stop 170 ensures that a consistent countersink profile is created in the metal wall of the panel or other object each time so that the countersink profile created in the object, and the countersink profile of each post of the electrical connector is substantially the same. The countersink cutter 168 pierces or cuts through any non-conductive coatings on the metal walls 12 and 14 of the panel 10 to expose the metal of the object, e.g., the metal walls.

Having substantially the same countersink profiles in the metal walls 12 and 14 and the electrical connector posts, e.g., the male and/or female posts described above, ensures a better electrical connection between the electrical connector and the metal walls 12 and 14. To provide a smooth finish surface when cutting a countersink in the metal wall, the countersink cutter 168 may include a grindstone 172 adjacent the stop 170, seen in FIGS. 20 and 21. The grindstone 172 may be knurling cut into the countersink cutter or an abrasive embedded into an outer surface of the countersink cutter or adhered to an outer surface of the countersink cutter using for example an adhesive, such as a high strength epoxy.

Figure 22:
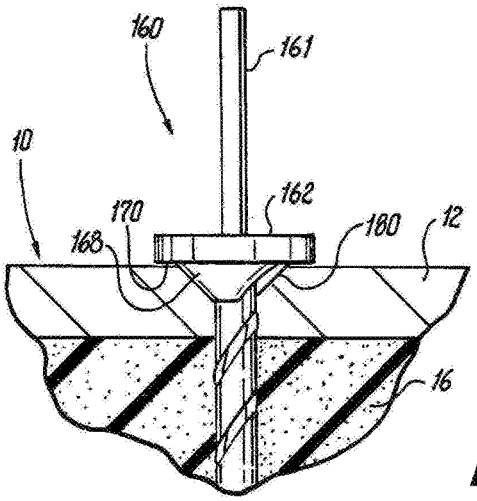
FIG. 22 is a side elevation view of the drill bit and countersink adapter of FIG. 16 creating a countersink in a metal wall of the panel of FIG. 1.
Figure 23:
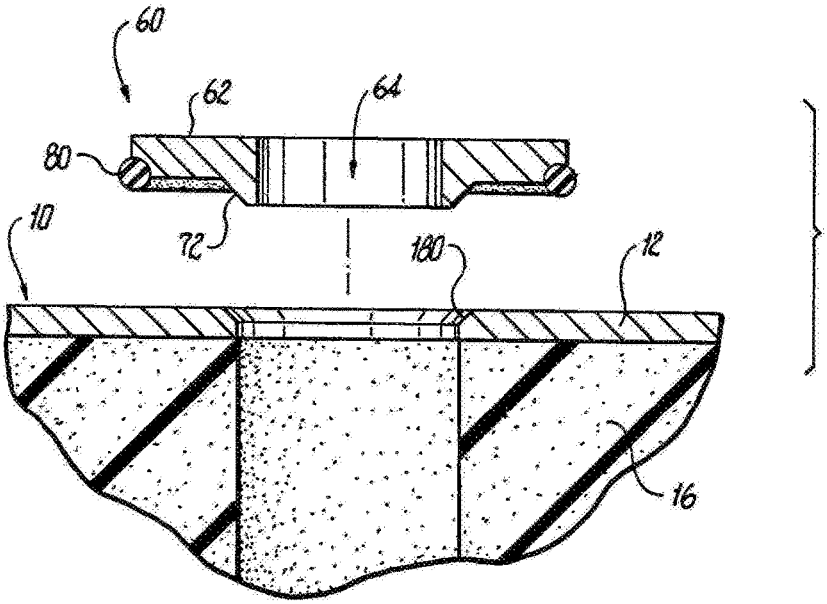
FIG. 23 is an enlarged view of the washer of FIG. 3 having a countersink profile matching a countersink profile in the metal wall of the panel of FIG. 1.
Figure 24:
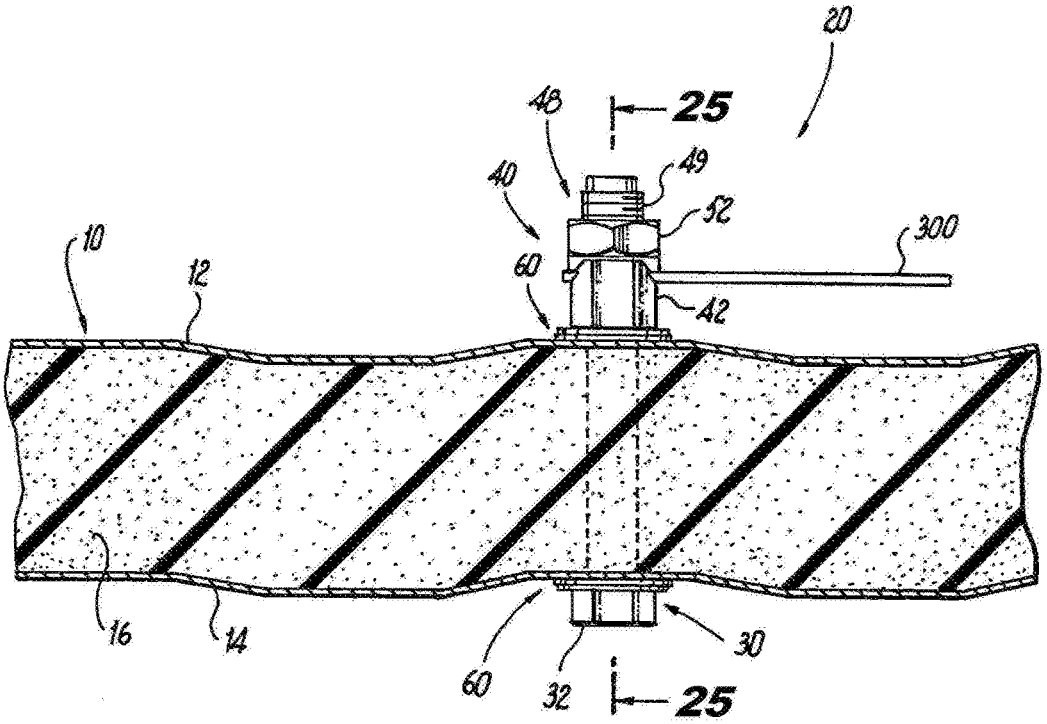
FIG. 24 is a side elevation view of the electrical connector of FIG. 2 secured to the panel of FIG. 1 and having a conductor secured to the electrical connector.

Referring now to FIGS. 22-27, installation of an electrical connector according to the present disclosure will be described. In this exemplary embodiment, the electrical connector is the electrical connector 20 of FIGS. 2-6. Initially, a hole is drilled in each metal wall 12 and 14 of panel 10 using, for example, the drill bit 161 of FIG. 16. Using the countersink adapter 160 of FIGS. 14-19 or FIGS. 20 and 21, the drill hole in the metal walls is then countersunk until stop 170 in countersink adapter 160 contacts an outer surface of the wall 12 or 14, such that the countersink profile 180 of the panel walls is substantially the same as the countersink profile 72 of the washers 60, as shown in FIGS. 22 and 23. The male post 30 having a washer 60 inserted over the male post is then inserted into the drill hole on, for example, wall 14 side of the panel 10, as seen in FIGS. 24 and 25. A second washer 60 is then inserted onto the threaded free end of the stem 34 of the male post 30 extending out of, for example, the wall 12 side of the panel 10. The mounting aperture 44 of the female post 40 is then threaded onto the threaded portion of the stem 34 of the male post 30 until the female post is tightly secured to the male post. As seen in FIG. 26, when the female post 40 is tightly secured to the male post 30, the countersink profile 72 of the washer 60 fits within the countersink profile 180 of the countersink made by the countersink adapter 160. In addition, the seal member 80 is compressed against the wall 12 to provide a watertight seal between the washer 60 associated with the female post 40 and the wall 12. As seen in FIG. 27, when the male post 30 is tightly secured to the female post 40, the countersink profile 72 of the washer 60 fits within the countersink profile 180 of the countersink made by the countersink adapter 160. In addition, the seal member 80 is compressed against the wall 14 to provide a watertight seal between the washer 60 associated with the male post 30 and the wall 14.

Figure 30:
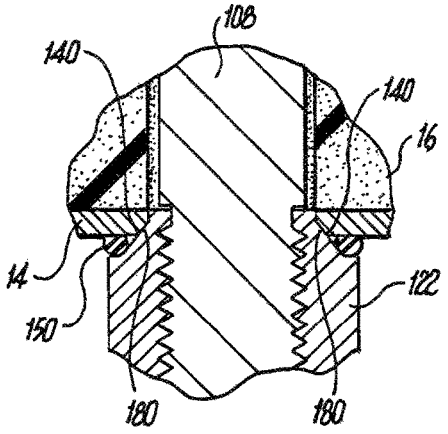
FIG. 30 is an enlarged cross-sectional view of the interconnection between the female post of the electrical connector of FIG. 8 and the panel of FIG. 1.
Figure 31:
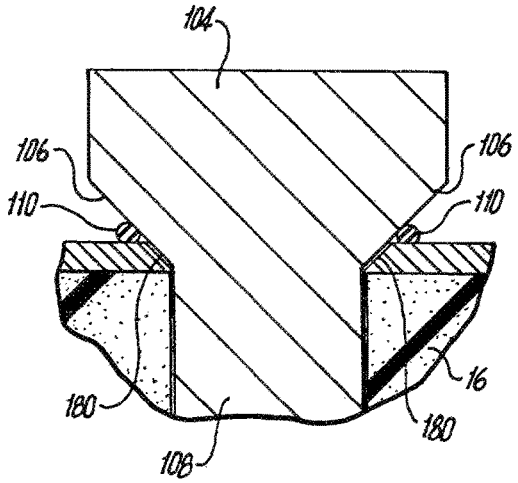
FIG. 31 is an enlarged cross-sectional view of the interconnection between the male post of the electrical connector of FIG. 8 and the panel of FIG. 1.

Referring now to FIGS. 28-31, installation of another electrical connector according to the present disclosure will be described. In this exemplary embodiment, the electrical connector is the electrical connector 100 of FIGS. 8-13. Initially, a hole is drilled in each metal wall 12 and 14 of panel 10 using, for example, the drill bit 161 of FIG. 16. Using the countersink adapter 160 of FIGS. 16-19 or FIGS. 20 and 21, the drill hole in the metal walls is then countersunk until stop 170 in countersink adapter 160 contacts an outer surface of the wall 12 or 14, such that the countersink profile 180 of the walls is substantially the same as the countersink profile 72 of the washers 60. In this embodiment, the male post 102 having a seal member 110 adjacent the countersink profile 106, seen in FIG. 10, is then inserted into the drill hole on, for example, the wall 12 side of the panel 10, as seen in FIGS. 28 and 29. The female post 120 is then threaded onto the threaded free end of the stem 108 of the male post 102 extending out of wall 14 until the female post 120 is tightly secured to the male post 102. As seen in FIG. 30, when the female post 120 is tightly secured to the male post 102, the countersink profile 140 of the female post 120 fits within the countersink profile 180 of the countersink made by the countersink adapter 160. In addition, the seal member 150 is compressed against the wall 14 to provide a watertight seal between the female post 120 and the wall 14. As seen in FIG. 31, when the male post 102 is tightly secured to the female post 120, the countersink profile 106 of the male post 102 fits within the countersink profile 180 of the countersink made by the countersink adapter 160. In addition, the seal member 110 is compressed against the wall 12 to provide a watertight seal between the male post 102 and the wall 12.

Figure 32:
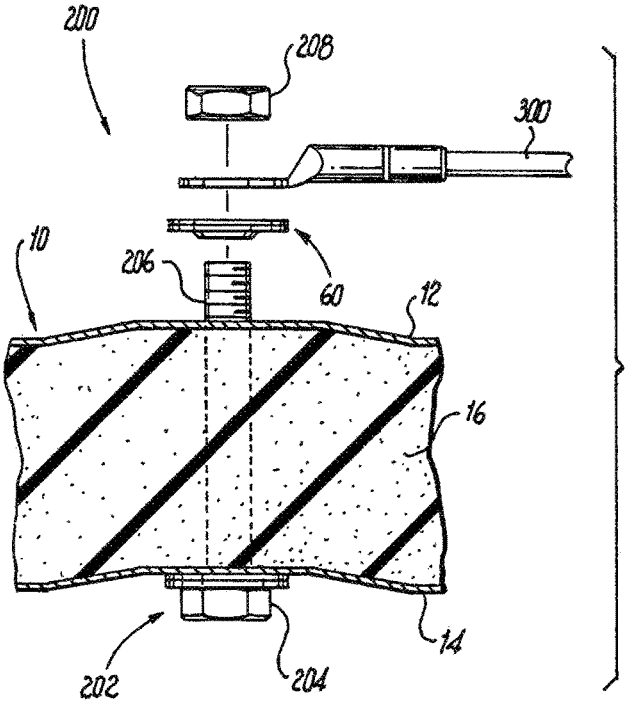
FIG. 32 is a side elevation view of the electrical connector of FIGS. 14 and 15 positioned secured to the panel of FIG. 1 and having a conductor positioned for attachment to the electrical connector.
Figure 33:
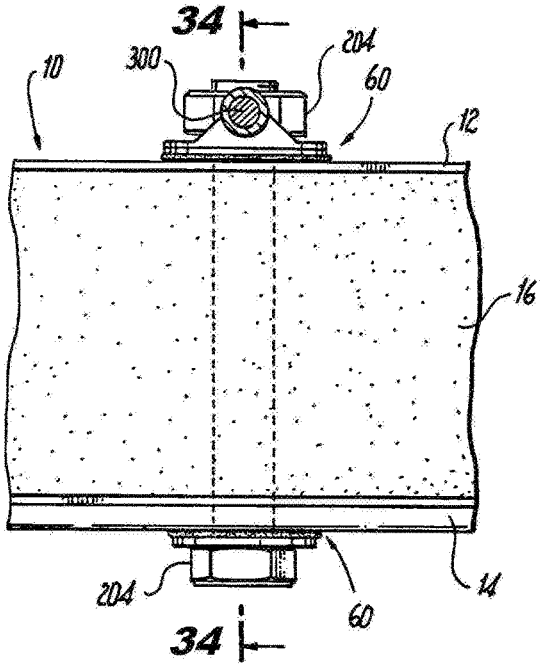
FIG. 33 side elevation view of the electrical connector of FIGS. 14 and 15 secured to the panel of FIG. 1 and having the conductor attached to the electrical connector.
Figure 34:
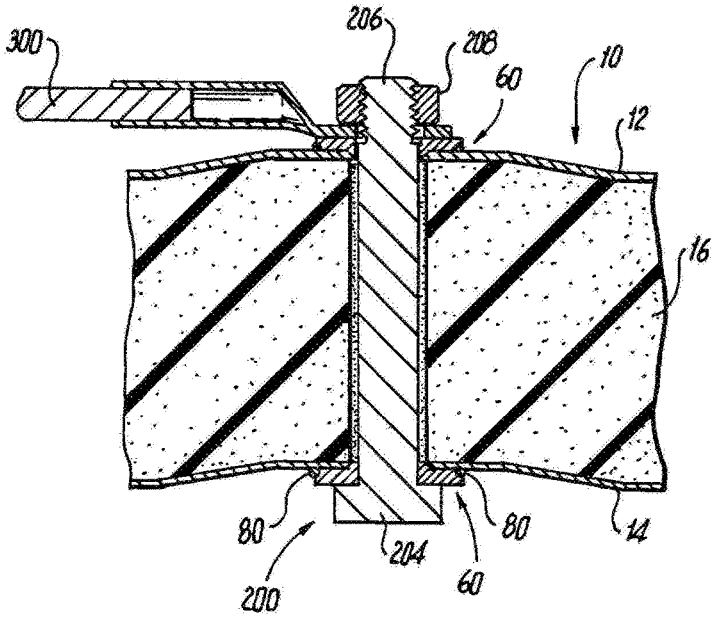
FIG. 34 is a cross-sectional view of the electrical connector and panel of FIG. 33 taken along line 34-34.

Referring now to FIGS. 32-34, installation of another electrical connector according to the present disclosure will be described. In this exemplary embodiment, the electrical connector is the electrical connector 200 of FIGS. 14 and 15. Initially, a hole is drilled in each metal wall 12 and 14 of panel 10 using, for example, the drill bit 161 of FIG. 16. Using the countersink adapter 160 of FIGS. 16-19 or FIGS. 20 and 21, the drill hole in the metal walls is then countersunk until stop 170 in countersink adapter 160 contacts an outer surface of the wall 12 or 14, such that the countersink profile 180 of the walls is substantially the same as the countersink profile 72 of the washers 60. The male post 202 having a washer 60 inserted over the stem 206 is then inserted into the drill hole on, for example, wall 14 side of the panel 10, as seen in FIG. 32. A second washer 60 is then inserted onto the threaded free end of the stem 206 of the male post 202 extending out of, for example, the wall 12 side of the panel 10. The conductor clamping member 208 is then threaded onto the threaded portion of the stem 206 of male post 202 until the conductor clamping member 208 is tightly secured to the male post, as seen in FIG. 33. Referring to FIG. 34, when the conductor clamping member 208 is tightly secured to the male post 202, the countersink profile 72 of each washer 60 fits within the respective countersink profile 180 of the countersink made by the countersink adapter 160 in wall 12 or 14. In addition, the seal member 80 of each washer 60 is compressed against the wall 12 or 14 to provide a watertight seal between the washer 60 and the respective wall.

Figure 35:
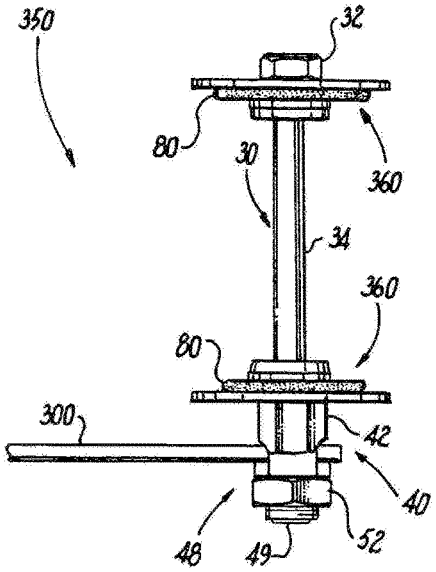
FIG. 35 is a side elevation view of another exemplary embodiment of an electrical connector according to the present disclosure, illustrating a male post coupled to a female post with washers used to establish electrical connections between conductors and metal objects and for facilitating a watertight seal.
Figure 36:
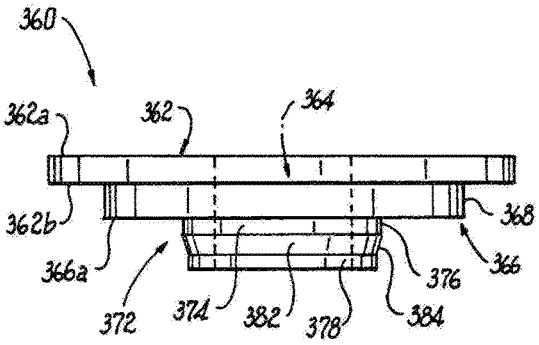
FIG. 36 is side elevation view of an exemplary embodiment of the washer of FIG. 35 without a seal member.
Figure 37:
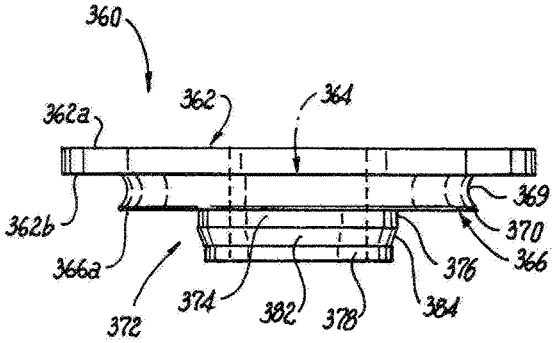
FIG. 37 is side elevation view of another exemplary embodiment a washer for the electrical connector of FIG. 35 without a seal member.

Referring now to FIG. 35, another exemplary embodiment of an electrical connector according to the present disclosure is shown. In this exemplary embodiment, the electrical connector 350 includes a male post 30, a female post 40, and a pair of washers 360. The male post 30 and the female post 40 are the same as the male post 30 and female post 40 described above. As such, a description of the male post and the female post will not be repeated.

Referring to FIGS. 35-39, another exemplary embodiment of the washer according to the present disclosure is shown. In this exemplary embodiment, the washer 360 includes a base 362 having a circular shape with a substantially flat top surface **362*a* and a bottom surface 362*b* and an aperture 364 in a center portion of the base 362 for receiving the stem, e.g., stem 34, of the male post 30. Extending from the bottom surface 362*b* of the base 362 adjacent the periphery of the base is a seal member retainer 366, seen in FIG. 36, for releasable attaching a seal member 80, seen in FIGS. 4 and 35, to the washer 360. The seal member retainer 366 is a circular member having an outer diameter that is preferably smaller than the outer diameter of the base 362. In the exemplary embodiment shown in FIG. 36, the seal member 80 is an O-ring and the seal member retainer 366 is a ring that includes a substantially flat surface 368 that can releasable attach the seal member 80 to the washer 360 via a friction fit. In the exemplary embodiment shown in FIG. 37, the seal member 80 is an O-ring and the seal member retainer 366 is a ring that includes an arcuate surface 369 having a lip 370 to provide a better releasable attachment of the seal member 80 to the washer 360. The seal member 80** provides a watertight seal between the washer 360 and a metal wall of a panel, e.g., panel 10 or other object.

Figure 38:
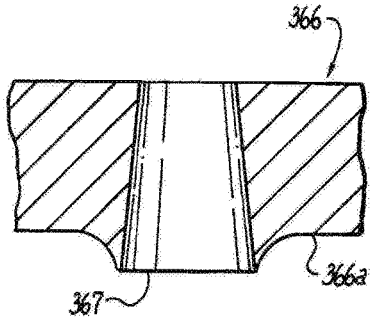
FIG. 38 is an enlarged view of a portion of the washer of FIG. 36 or FIG. 37 illustrating a penetrating tooth for piercing non-conductive coatings.
Figure 39:
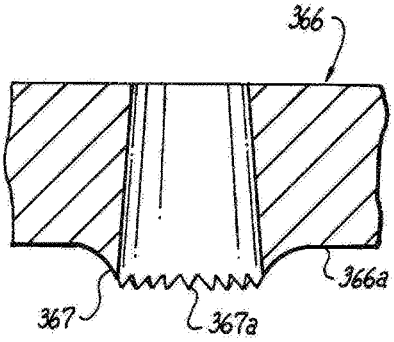
FIG. 39 is an enlarged view of another exemplary embodiment of the portion of the washer of FIG. 38 illustrating the penetrating tooth with serrations for piercing non-conductive coatings.

The bottom surface 366*a* of the seal member retainer 366 may include one or more electrical bonding members 367, seen in FIGS. 38 and 39, which may be for example a tooth or what is sometimes called in the industry a "volcano." Each electrical bonding member 367 is capable of cutting through or piercing non-conductive coatings on the object, e.g., panel walls 12 and 14, that protect the panel from corrosion. Examples of such non-conductive coatings include oxide, paint and/or anodization. Each electrical bonding member 367 can be a unitary circular or other shaped tooth or structure, seen for example in FIG. 38 that is capable of cutting through or piercing the non-conductive coatings on the object, e.g., panel walls 12 or 14. In another embodiment, each electrical bonding member 367 can be a unitary circular or other shaped tooth or structure having a serrated distal edge 367*a*, seen in FIG. 39, that is also capable of cutting through or piercing the non-conductive coatings on the object, e.g., panel walls 12 or 14. The electrical bonding members 367 can be extruded from the seal member retainer 366, or they can be secured to the seal member retainer 366 by for example welding.

Figure 40:
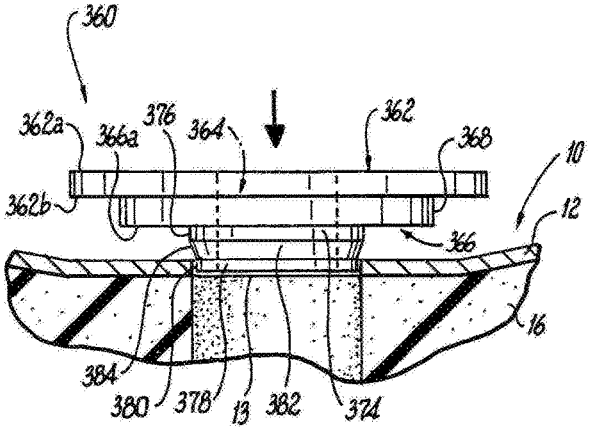
FIG. 40 is a side elevation view of the washer of FIG. 36 without a seal member being inserted into a pre-drilled hole in an object.
Figure 41:
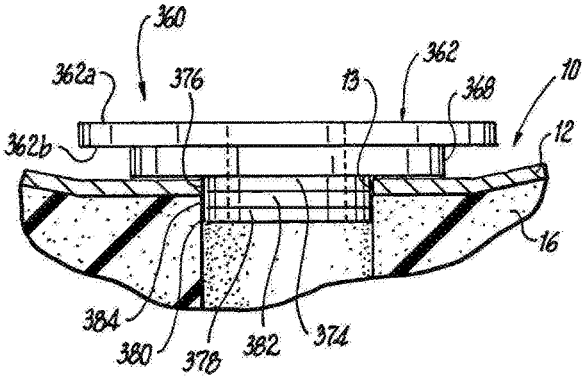
FIG. 41 is a side elevation view of the washer of FIG. 40 press fit within the pre-drilled hole in the object.

Referring again to FIGS. 36 and 37, extending from the bottom surface 362*b* of the base 362 is an anchor member 372 surrounding the aperture 364. In this exemplary embodiment, the anchor member 372 is a single unitary member having a base ring 374 with a substantially straight outer wall 376, an end ring 378 with a substantially straight outer wall 380, and a middle ring 382 with a tapered outer wall 384. The base ring 374 has a larger outer diameter than the end ring 376, and the middle ring tapered outer wall 384 joins the base ring outer wall 376 to the end ring outer wall 380. In this exemplary embodiment, the anchor member 372 of the washer 360 is used to releasably secure the washer 360 to an object, e.g., panel 10, with a press-fit connection. To illustrate and referring to FIGS. 40 and 41, the panel 10 would have a pre-drilled hole 13 in the metal outer wall 12 and the metal inner wall 14 for receiving the electrical connector 350. The pre-drilled hole 13 would have a diameter that is slightly larger than the outer diameter of the end ring outer wall 380 so that the end ring 378 can be easily inserted into the pre-drilled hole 13. With the end ring 378 of the anchor member 372 in the pre-drilled hole 13 the washer 360 can then be forced into the pre-drilled hole 13 using, for example, a hammer or press. Forcing the washer 360 into the pre-drilled hole 13 causes the tapered outer wall 384 of the middle ring 382 and the outer wall 376 of the base ring 374 to mate with the side wall of the pre-drilled hole for the press fit seen in FIG. 41. By press fitting the side wall of the pre-drilled hole 13, which is exposed metal due to the drilling, with the tapered outer wall 384 of the middle ring 382 and the outer wall 376 of the base ring 374, the anchor member 372 is used to establish a conductive path between the panel 10 and the washer 360. For example, the anchor member 372 can be used to facilitate grounding and/or electrically bonding the electrical connector 350 to panel 10.

Referring to FIGS. 42-45, another exemplary embodiment of the washer according to the present disclosure is shown. In this exemplary embodiment, the washer 360 includes a base 362 having a circular shape with a substantially flat top surface 362*a* and a bottom surface 362*b* and an aperture 364 in a center portion of the base 362 for receiving the stem, e.g., stem 34, of the male post 30. Extending from the bottom surface 362*b* of the base 362 adjacent the periphery of the base is a seal member retainer 366, seen in FIG. 42, for releasable attaching a seal member 80, seen in FIGS. 4 and 35, to the washer 360. The seal member retainer 366 is a circular member having an outer diameter that is preferably smaller than the outer diameter of the base 362. In the exemplary embodiment shown in FIG. 42, the seal member 80 is an O-ring and the seal member retainer 366 is a ring that includes a substantially flat surface 368 that can releasable attach the seal member 80 to the washer 360 via a friction fit. In the exemplary embodiment shown in FIG. 43, the seal member 80 is an O-ring and the seal member retainer 366 is a ring that includes an arcuate surface 369 having a lip 370 to provide a better releasable attachment of the seal member 80 to the washer 360. The bottom surface 366*a* of the seal member retainer 366 may also include one or more electrical bonding members 367, as described above.

Figure 42:
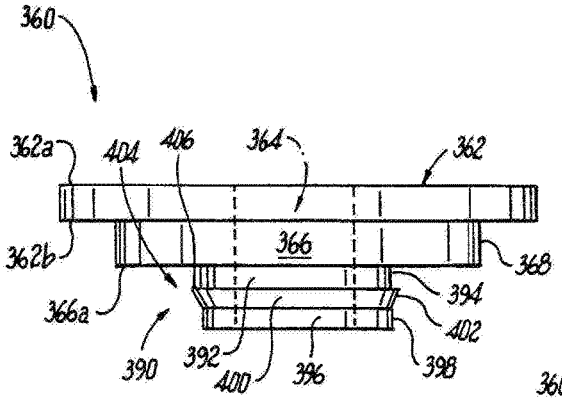
FIG. 42 is side elevation view of another exemplary embodiment of a washer for the electrical connector of FIG. 35 without a seal member.
Figure 43:
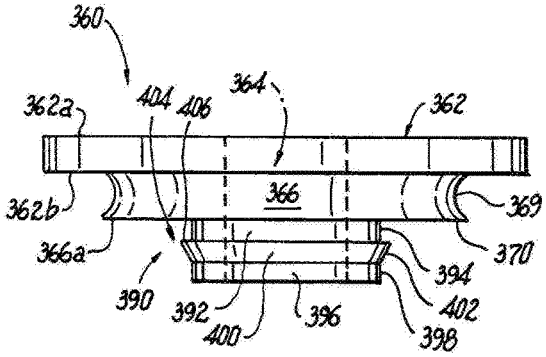
FIG. 43 is side elevation view of another exemplary embodiment of a washer for the electrical connector of FIG. 35 without a seal member.
Figure 44:
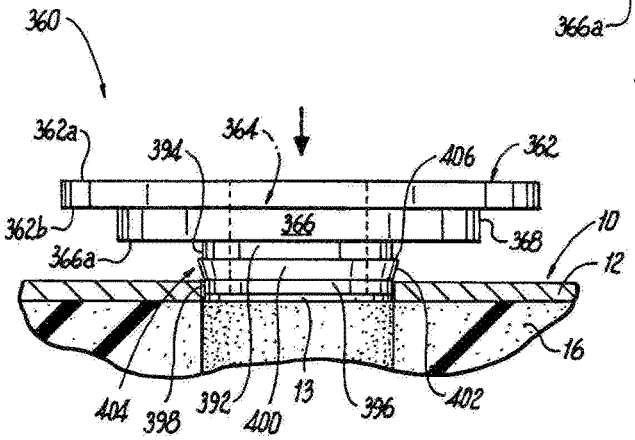
FIG. 44 is a side elevation view of the washer of FIG. 42 without a seal member being inserted into a pre-drilled hole in an object.
Figure 45:
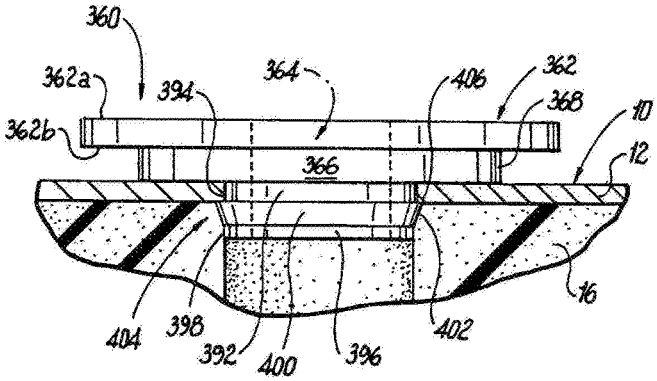
FIG. 45 is a side elevation view of the washer and object of FIG. 44, illustrating a wedged fit of the washer within the pre-drilled hole in the object.

Extending from the bottom surface 362*b* of the base 362 is an anchor member 390 surrounding the aperture 364, as shown in FIGS. 42 and 43. In this exemplary embodiment, the anchor member 390 is a single unitary member having a base ring 392 with a substantially straight outer wall 394, an end ring 396 with a substantially straight outer wall 398, and a middle ring 400 with a tapered outer wall 402. In this embodiment, the base ring 374 has substantially the same outer diameter as the end ring 396, and the middle ring tapered outer wall 402 forms a barb 404 between the base ring 392 and the end ring 396 that is used to wedge an object, e.g., a panel wall 12 or 14, between the seal member retainer 366 and the middle ring 400. Thus, the anchor member 390 of the washer 360 is used to releasably secure the washer 360 to an object, e.g., a panel wall 12 or 14, with a wedge connection. To illustrate and referring to FIGS. 44 and 45, the panel 10 would have a pre-drilled hole 13 in the metal outer wall 12 and metal inner wall 14 for receiving the electrical connector 350. The pre-drilled hole 13 would have a diameter that is the same as the outer diameter of the end ring outer wall 398 so that the end ring 396 can be easily inserted into the pre-drilled hole 13. With the end ring 398 of the anchor member 390 in the pre-drilled hole 13, the washer 360 can then be forced into the pre-drilled hole 13 using, for example, a hammer or press. Forcing the washer 360 into the pre-drilled hole 13 causes the tapered outer wall 402 of the middle ring 400 to flex inwardly so that the tip 406 of the barb 404 can pass through the pre-drilled hole 13. Once the tip 406 of the barb 404 passes through the pre-drilled hole 13 the force applied to flex the tapered outer wall 402 of the middle ring 400 is removed so that the tapered outer wall 402 can return to its normal, un-flexed state wedging the base ring 392 of the anchor member 390 within the pre-drilled hole 13 between the seal retainer member 366 and the middle ring 400 of the anchor member 39, as shown in FIG. 45. In this embodiment, to maintain a tight fit between the seal retaining member 366 and the middle ring 400 of the anchor member 390 the thickness of the base ring 392 is slightly less than the thickness of the panel wall 12 or 14. By wedging the base ring 392 of the anchor member 390 within the pre-drilled hole 13, the side wall of the pre-drilled hole 13, which is exposed metal due to the drilling, is in contact with the outer wall 394 of the base ring 392. The exposed metal of the side wall of the pre-drilled hole 13 in contact with the outer wall 394 of the base ring 392 is used to create a conductive path between the panel wall 12 or 14 and the washer 360. For example, the anchor member 390 can be used to facilitate grounding and/or electrically bonding the electrical connector 350 to panel 10.

Figure 46:
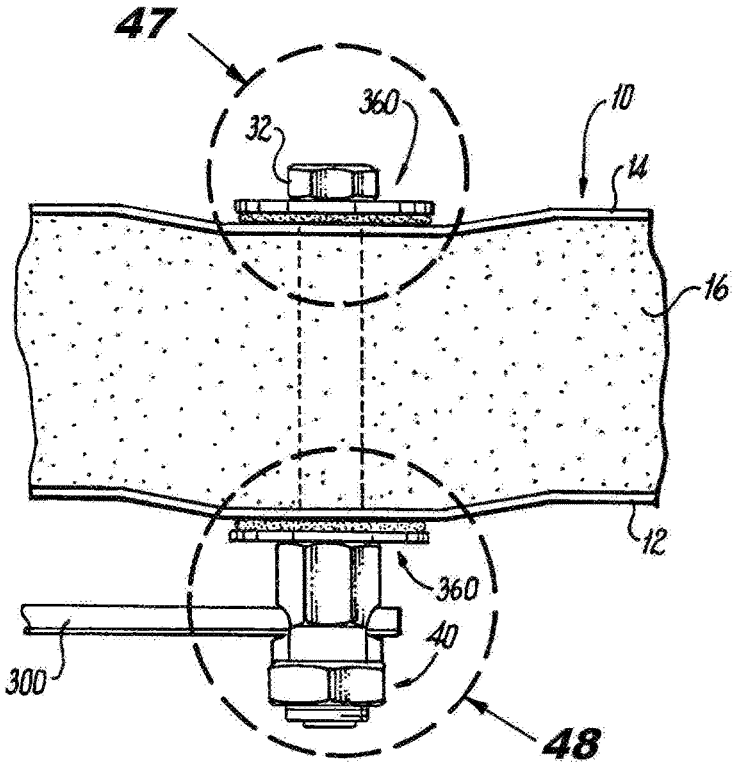
FIG. 46 is a side elevation view of the electrical connector of FIG. 35 secured to the panel of FIG. 1 and having a conductor secured to the electrical connector.
Figure 47:
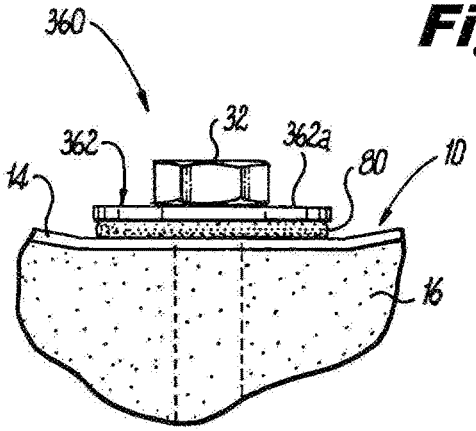
FIG. 47 is an enlarged view of the interconnection between the male post of the electrical connector and the panel of FIG. 46.
Figure 48:
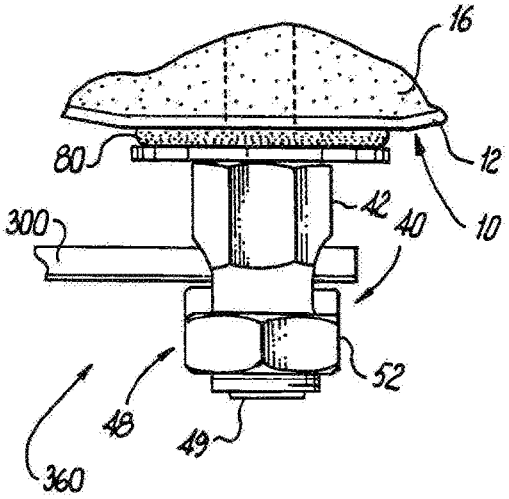
FIG. 48 is an enlarged view of the interconnection between the female post of the electrical connector and the panel of FIG. 46.

Similar to the above described embodiments, the male posts, female posts and the washers are made of an electrically conductive material that establishes electrical connections between conductors and objects, such as panel 10. For example, male posts, female posts and the washers are made of an electrically conductive material that facilitates the grounding and/or electrical bonding function of the electrical connector 10. In the exemplary embodiments of the present disclosure, examples of electrically conductive metals include cast copper alloy, copper, brass, steel, stainless steel, galvanized steel, silicone bronze, tin, aluminum, or aluminum alloy. Referring to FIGS. 46 and 48, as described above, the seal member 80 provides a watertight seal between the washer 360 and a metal wall 12 or 14 of a panel, e.g., panel 10, or other object in that the seal member 80 is compressed between the bottom surface 362*b* of the base 362 and the panel wall 12 or 14 around the pre-drilled hole 13 in the panel wall thus providing a watertight seal.

Figure 49:
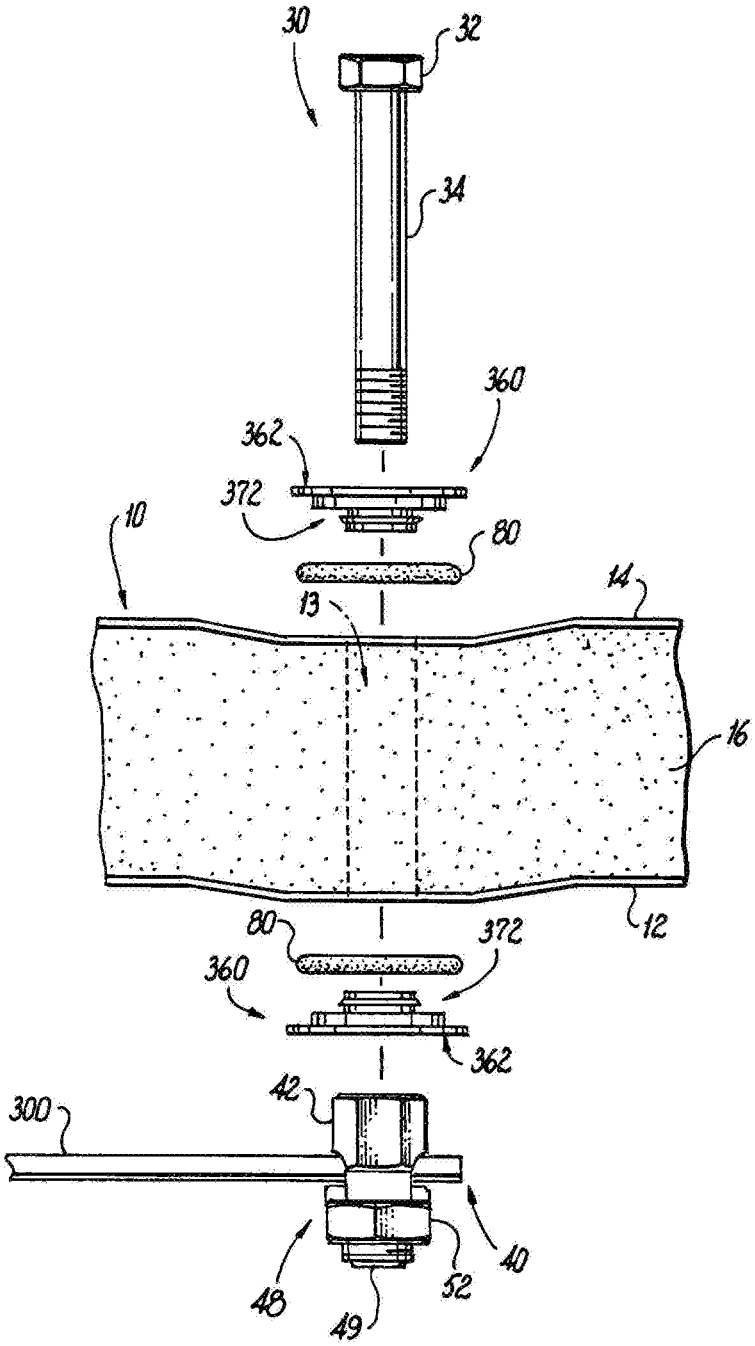
FIG. 49 is a side elevation view with part separated of the electrical connector of FIG. 35 being secured to the panel of FIG. 1.
Figure 50:
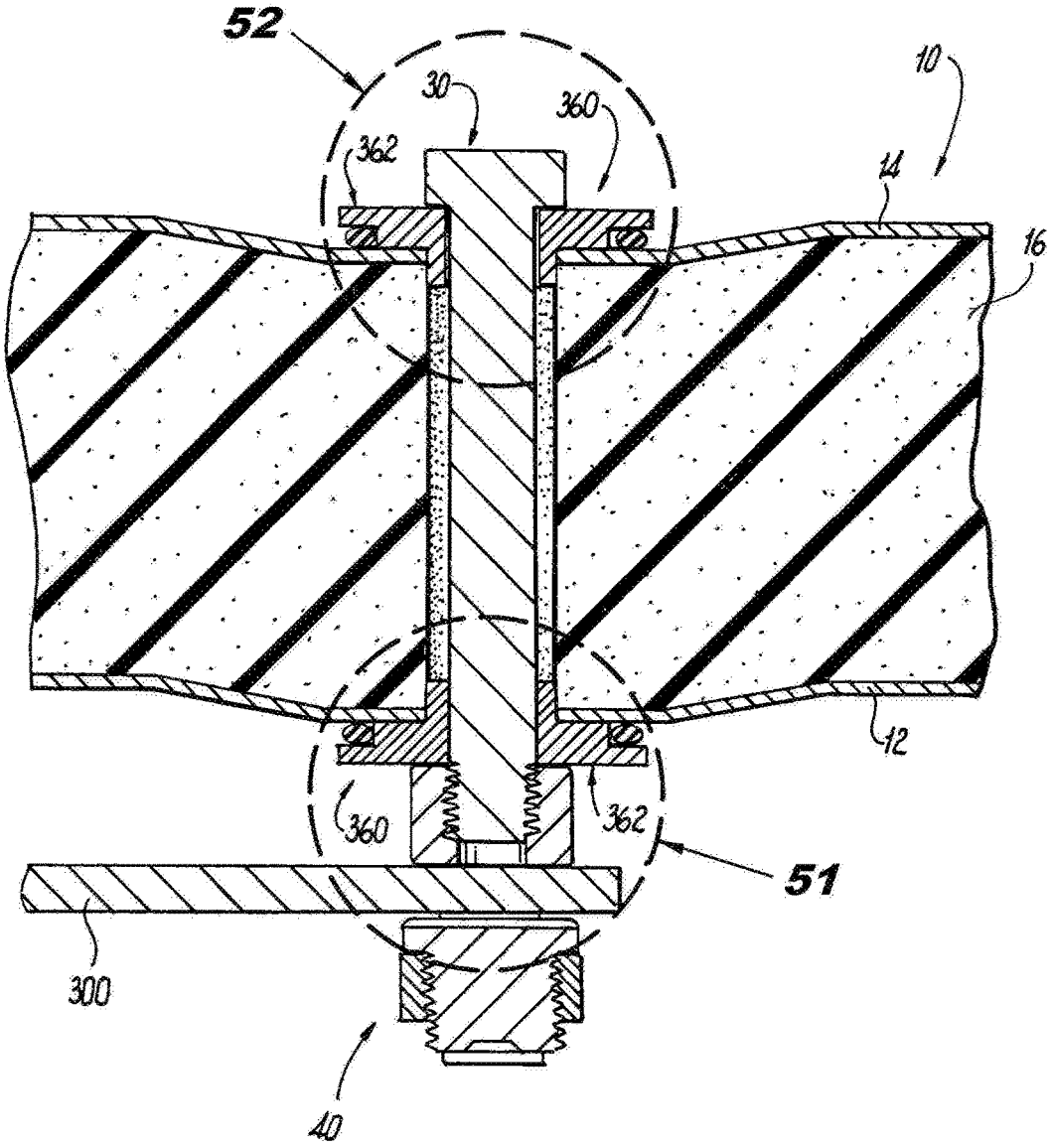
FIG. 50 is a cross-sectional view of the electrical connector and panel of FIG. 46.

Referring now to FIGS. 49-52, installation of an electrical connector according to the present disclosure will be described. In this exemplary embodiment, the electrical connector is the electrical connector 350 of FIGS. 35, 36, 40, 41 and 46. Initially, a hole is drilled each metal wall 12 and 14 of panel 10 using, for example, the drill bit 161 of FIG. 16 without the countersink adapter. This hole is the pre-drilled hole 13 noted above. An end ring 378 of a first washer 360 having a seal member 80 within the seal member retainer 366 is then inserted into the pre-drilled hole 13 in the panel wall 12 and the first washer 360 is forced into the hole for a press fit as described above. An end ring 378 of a second washer 360 having a seal member 80 within the seal member retainer 366 is then inserted into the pre-drilled hole 13 in the panel wall 14 and the second washer is forced into the hole for a press fit. With the first and second washers in place, a male post 30 is inserted into the aperture 364 of, for example, the second washer 360, through the panel 10 and exits the aperture 364 in the first washer 360, as seen in FIGS. 49 and 50. The mounting aperture 44 of the female post 40 is then threaded onto the threaded portion of the stem 34 of the male post 30 until the female post is tightly secured to the male post.

Figure 51:
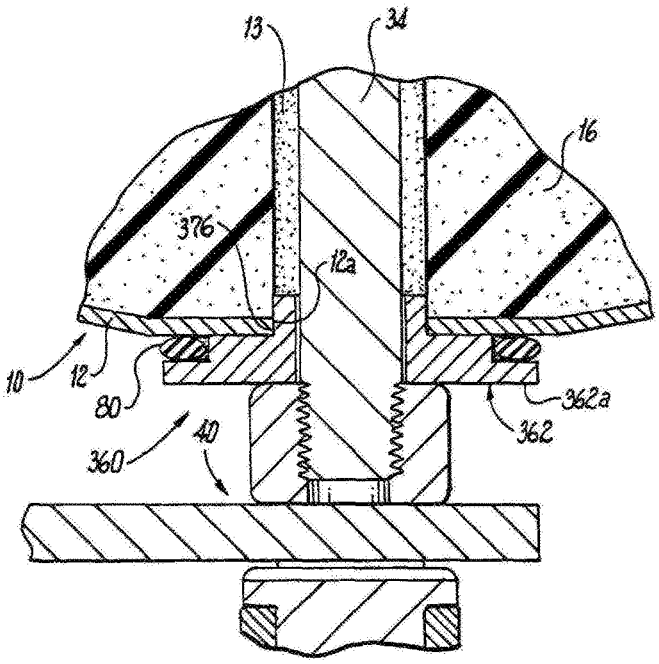
FIG. 51 is an enlarged cross-sectional view of the interconnection between the female post of the electrical connector and the panel of FIG. 50.
Figure 52:
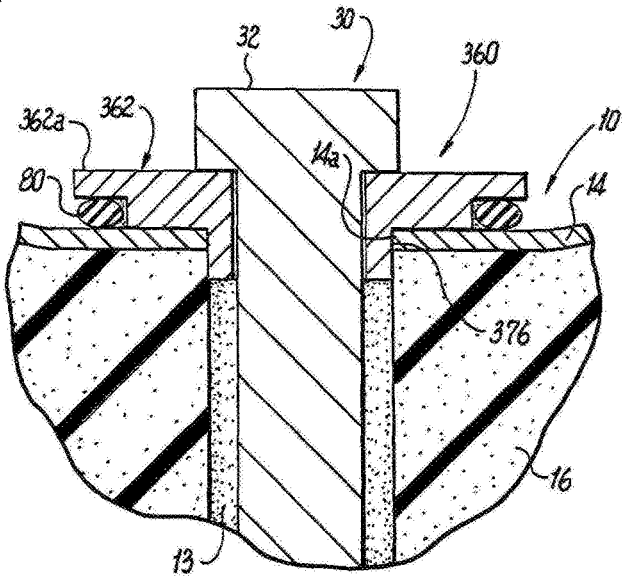
FIG. 52 is an enlarged cross-sectional view of the interconnection between the male post of the electrical connector and the panel of FIG. 50 taken from detail 52.

As seen in FIG. 51, with the anchor members 372 of the first washer 360 press fit within the pre-drilled hole 13 in panel wall 12, at least the outer wall 376 of the anchor member 372 contacts side wall 12*a* of the pre-drilled hole 13, which has the bare metal exposed due to the drilling of the hole. The contact between the side wall 12*a* and the outer wall 376 creates an electrically conductive path between the panel wall 12 and the first washer 360. The female post 40 then contacts the top surface 362*a* of the base 362 of the first washer 360 to create an electrically conductive path between first washer 360 and the female post. When a conductor 300 is secured to the female post 40, as described above, an electrically conductive path is created between the conductor 300 and the panel wall 12. Further, as seen in FIG. 52, with the anchor member 372 of the second washer 360 press fit within the pre-drilled hole 13 in panel wall 14, at least the outer wall 376 of the anchor member 372 contacts wall 14*a* of the pre-drilled hole 13, which has the bare metal exposed due to the drilling of the hole. The contact between the side wall 14*a* and the outer wall 376 creates an electrically conductive path between the panel wall 14 and the second washer 360. The male post 30 then contacts the top surface 362*a* of the base 362 of the second washer 360 to create an electrically conductive path between second washer 360 and the male post 30. As a result, an electrically conductive path is created between panel wall 14, panel wall 12 and the conductor 300 through the male post 30, female post 40 and the first and second washers 360.

In addition, when the male post 30 is tightened to the female post 40, the seal member 80 is compressed against the wall 12 to provide a watertight seal between the first washer 360 and the wall 12. Similarly, the seal member 80 of the second washer 360 is compressed against the wall 14 to provide a watertight seal between the second washer 360 and the wall 14.

While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. An electrical connector that can be connected to two separated metal components of a structure to electrically bond the two separated metal components, the electrical connector comprising:

an electrically conductive first post having a first washer, the first washer comprising:

an electrically conductive first base having a first structure contacting surface that can at least partially contact a first of the two metal components;

an electrically conductive first seal member retainer extending from the first structure contacting surface;

a first seal member positioned on the first seal member retainer and used to create a watertight seal between the first washer and the first metal component when the electrical connector is connected to the two separated metal components; and an electrically conductive first press fit anchor member, extending from the first seal member retainer and used when attaching the first washer to the first metal component when the electrical connector is connected to the two separated metal components such that when the electrical connector is connected to the two separated metal components an electrically conductive path is established between the first press fit anchor member and the first metal component; and an electrically conductive second post that can be attached to the first post, the second post having a second washer, the second washer comprising:

an electrically conductive second base having a second structure contacting surface that can at least partially contact a second of the two metal components;

an electrically conductive second seal member retainer extending from the second structure contacting surface;

a second seal member positioned on the second seal member retainer and used to create a watertight seal between the second washer and the second metal component when the electrical connector is connected to the two separated metal components; and an electrically conductive second press fit anchor member extending from the second seal member retainer and used when attaching the second washer to the second metal component when the electrical connector is connected to the two separated metal components such that when the electrical connector is connected to the two separated metal components an electrically conductive path is established between the second press fit anchor member and the second metal component.

2. The electrical connector according to claim 1, wherein the first anchor member comprises:

a base ring having an outer wall;

an end ring having an outer wall; and a middle ring having a tapered outer wall that joins the base ring outer wall to the end ring outer wall.

3. The electrical connector according to claim 1, wherein the second anchor member comprises:

a base ring having an outer wall;

an end ring having an outer wall; and a middle ring having a tapered outer wall that joins the base ring outer wall to the end ring outer wall.

4. The electrical connector according to claim 1, wherein the first post is a female post and the second post is a male post.

5. The electrical connector according to claim 1, wherein the electrically conductive first post and first washer are made of one of cast copper alloy, copper, brass, steel, stainless steel, galvanized steel, silicone bronze, tin, aluminum, or aluminum alloy.

6. The electrical connector according to claim 1, wherein the electrically conductive second post and second washer are made of one of cast copper alloy, copper, brass, steel, stainless steel, galvanized steel, silicone bronze, tin, aluminum, or aluminum alloy.

7. The electrical connector according to claim 1, wherein the first post is a male post and the second post is a female post.

8. The electrical connector according to claim 7, wherein the male post comprises a head and a stem extending from the head and having a free end.

9. The electrical connector according to claim 7, wherein the female post comprises:

a base having a mounting aperture at one end and a conductor support at another end configured to support a conductor; and a conductor attaching assembly coupled to the base used to clamp a conductor to the female post.

10. The electrical connector according to claim 9, wherein the conductor attaching assembly comprises:

a split bolt extending from the base and having a channel configured to receive the conductor; and a clamping member within the channel that is coupled to a clamping member adjuster coupled to the split bolt such that when the clamping member adjuster is moved along the split bolt to an open position the clamping member moves to the open position, and when clamping member adjuster is moved along the split bolt to a clamping position the clamping member moves to the clamping position where the conductor being supported by the conductor support is clamped to the female post.

11. An electrical connector for electrically bonding two separated metal components of a structure, the electrical connector comprising:

an electrically conductive first post having a first washer, the first washer comprising:

an electrically conductive first base having a first structure contacting surface that can at least partially contact a first of the two metal components;

an electrically conductive first seal member retainer extending from the first structure contacting surface;

a first seal member positioned on the first seal member retainer and used to create a watertight seal between the first washer and the first metal component when the electrical connector is connected to the two separated metal components; and an electrically conductive first wedge fit anchor member extending from the first seal member retainer and used when attaching the first washer to the first metal component when the electrical connector is connected to the two separated metal components such that when the electrical connector is connected to the two separated metal components an electrically conductive path is established between the first wedge fit anchor member and the first metal component; and an electrically conductive second post that can be attached to the first post, the second post having a second washer, the second washer comprising:

an electrically conductive second base having a second structure contacting surface that can at least partially contact a second of the two metal components;

an electrically conductive second seal member retainer extending from the second structure contacting surface;

a second seal member positioned on the second seal member retainer and used to create a watertight seal between the second washer and the second metal component when the electrical connector is connected to the two separated metal components; and an electrically conductive second wedge fit anchor member extending from the second seal member retainer and used when attaching the second washer to the second metal component when the electrical connector is connected to the two separated metal components such that when the electrical connector is connected to the two separated metal components an electrically conductive path is established between the second wedge fit anchor member and the second metal component.

12. The electrical connector according to claim 11, wherein the first anchor member comprises:

a base ring having an outer wall;

an end ring having an outer wall; and a middle ring having a tapered outer wall forming a barb between the base ring outer wall to the end ring outer wall.

13. The electrical connector according to claim 11, wherein the second anchor member comprises:

a base ring having an outer wall;

an end ring having an outer wall; and a middle ring having a tapered outer wall forming a barb between the base ring outer wall to the end ring outer wall.

14. The electrical connector according to claim 11, wherein the first post is a female post and the second post is a male post.

15. The electrical connector according to claim 11, wherein the electrically conductive first post and first washer are made of one of cast copper alloy, copper, brass, steel, stainless steel, galvanized steel, silicone bronze, tin, aluminum, or aluminum alloy.

16. The electrical connector according to claim 11, wherein the electrically conductive second post and second washer are made of one of cast copper alloy, copper, brass, steel, stainless steel, galvanized steel, silicone bronze, tin, aluminum, or aluminum alloy.

17. The electrical connector according to claim 11, wherein the first post is a male post and the second post is a female post.

18. The electrical connector according to claim 17, wherein the male post comprises a head and a stem extending from the head and having a free end.

19. The electrical connector according to claim 17, wherein the female post comprises:

a base having a mounting aperture at one end and a conductor support at another end configured to support a conductor; and a conductor attaching assembly coupled to the base used to clamp a conductor to the female post.

20. The electrical connector according to claim 19, wherein the conductor attaching assembly comprises:

a split bolt extending from the base and having a channel configured to receive the conductor; and a clamping member within the channel that is coupled to a clamping member adjuster coupled to the split bolt such that when the clamping member adjuster is moved along the split bolt to an open position the clamping member moves to the open position, and when clamping member adjuster is moved along the split bolt to a clamping position the clamping member moves to the clamping position where the conductor being supported by the conductor support is clamped to the female post.

* * * * *